US007866510B2

(12) United States Patent
Schneider et al.

(10) Patent No.: US 7,866,510 B2
(45) Date of Patent: Jan. 11, 2011

(54) DEVICE FOR DISPENSING A FLUID FROM THE HOLLOW SPACE OF A CONTAINER

(75) Inventors: Peter Schneider, Wuert (DE); Rudolph Thewes, Oehringen (DE); Bernd Haeussler, Oehringen (DE); Karl-Friedrich Krause, Cologne (DE)

(73) Assignee: Huber Verpackungen GmbH + Co. Kg., Oehringen (DE)

( * ) Notice: Subject to any disclaimer, the term of this patent is extended or adjusted under 35 U.S.C. 154(b) by 751 days.

(21) Appl. No.: 11/599,081

(22) Filed: Nov. 14, 2006

(65) Prior Publication Data

US 2007/0114249 A1 May 24, 2007

Related U.S. Application Data

(63) Continuation of application No. PCT/EP2005/003228, filed on Mar. 26, 2005.

(30) Foreign Application Priority Data

Apr. 2, 2004 (DE) ..... 10 2004 017 171

(51) Int. Cl.
*B67B 1/00* (2006.01)

(52) U.S. Cl. ..... 222/153.06; 222/396; 222/399

(58) Field of Classification Search ..... 222/153.12, 222/394, 396, 399, 402.14, 153.01, 153.05, 222/153.06, 402.11
See application file for complete search history.

(56) References Cited

U.S. PATENT DOCUMENTS 3,347,417 A * 10/1967 Puster ..... 222/61
3,352,456 A * 11/1967 Swineford ..... 222/5
4,456,155 A * 6/1984 Miyata et al. ..... 222/396
5,368,207 A 11/1994 Cruysberghs et al.
5,398,851 A * 3/1995 Sancoff et al. ..... 222/386.5
6,053,475 A 4/2000 Batschied et al.
6,109,479 A * 8/2000 Ruckdeschel ..... 222/82
6,443,336 B2 * 9/2002 Antonetti et al. ..... 222/509
6,758,240 B2 * 7/2004 Gregoire ..... 137/505.42
2004/0050880 A1 3/2004 Fraser-Easton

FOREIGN PATENT DOCUMENTS

| | | |
|---|---|---|
| CH | 438 991 | 12/1967 |
| DE | 1 191 244 | 4/1965 |
| DE | 298 22 430 | 12/1998 |
| EP | 0349053 | 1/1990 |

* cited by examiner

*Primary Examiner*—Kevin P Shaver
*Assistant Examiner*—Daniel R Shearer
(74) *Attorney, Agent, or Firm*—Bracewell & Giuliani LLP

(57) ABSTRACT

Disclosed is a device for dispensing a fluid, in particular a carbonated beverage, from a storage chamber of a container towards the outside via at least one closeable discharge port, comprising a pressure reservoir which is separated from the storage chamber and in which a pressurized propellant is accommodated, and which can be connected to the storage chamber via a pressure regulation mechanism. The pressure regulation mechanism includes an axially moveable regulating element that is impinged upon by means of a spring in the direction of an open position in which propellant is discharged from the pressure reservoir into the storage chamber. The ambient pressure to which the container is exposed acts upon the regulating element in the direction of the open position, and the internal pressure inside the storage chamber of the container acts upon the regulating element in the direction of the closed position.

16 Claims, 2 Drawing Sheets

DEVICE FOR DISPENSING A FLUID FROM THE HOLLOW SPACE OF A CONTAINER

CROSSREFERENCES TO RELATED APPLICATIONS

This application is a continuation of International Patent Application PCT/EP2005/003238, filed on Mar. 26, 2005 designating the U.S., which International Patent Application has been published in German language and claims priority of German patent application 102004017171.8, filed on Apr. 2, 2004 the entire contents of which is incorporated herein by reference.

BACKGROUND OF THE INVENTION

The invention relates to a device for dispensing a fluid, in particular a fluid such as beer or the like, from a storage space of a container via at least one closeable dispenser outlet to the outside, comprising a pressure reservoir which is separated from the storage chamber and in which a pressurized propellant is accommodated, and which can be connected to the storage chamber via a pressure regulation mechanism.

Such a device is known from U.S. Pat. No. 5,368,207.

This latter device is a pressurized container, for example a spray can, comprising a first chamber in which a liquid under gas pressure is accommodated and can be dispensed from the container via a valve of the kind commonly found in spray cans. In order to produce the pressure in the first chamber of the container, a second chamber is provided inside the container, in which the second chamber a propellant is accommodated under high pressure. The propellant can be discharged from the second chamber into the first chamber via a pressure regulator provided to ensure that a constant pressure is maintained inside the first chamber. The pressure regulator includes a plunger that can be moveably guided inside a closed housing and is sealed at both ends against the housing wall. In combination with the housing, the plunger encloses at its one end a third chamber that is pressurized to a predetermined reference pressure. At the opposite end of the plunger, a lateral through opening to an outlet is formed that communicates with the first chamber and which can be opened or closed depending on the axial position of the plunger. Between each of the two ends of the plunger and the housing, a cavity is also enclosed due to a reduction in the diameter of the plunger, the cavity being connected via an inlet opening to the second chamber, in which the pressurized propellant is accommodated. Depending on the position of the plunger, propellant is thus able to escape from the second chamber into the first chamber of the container. If, for example, the pressure in the first chamber of the container decreases, for example because fluid is dispensed to the outside via the valve, this will lead to a displacement of the plunger in the direction of the open position due to the reference pressure in the third chamber acting upon the plunger. Hence, propellant is discharged from the second chamber into the first chamber, which leads to a pressure increase in the first chamber. The pressure regulator tries in this way to establish an equilibrium pressure in the first chamber that substantially depends on the reference pressure inside the third chamber.

Although such a pressure regulation mechanism is basically suitable for generating an approximately constant pressure inside a container, such as inside a spray can, the pressure regulation concept being applied involves considerable disadvantages.

If such a container is used, for example, to dispense carbonated beverages, such as beer, as known from DE 298 22 430 U1, for example, it is desirable to maintain a constant pressure that preferably corresponds to the equilibrium pressure between the fluid and the gas, regardless of the ambient pressure around the container. If one considers, for example, the specific application in party kegs with a volume of three, five or ten liters, for example, and in which beer is stored under $CO_2$ pressure, the pressure to be maintained even when drafting the beer, the resultant equilibrium pressure between the beer and the $CO_2$ is a function of the solubility of $CO_2$ in beer. Depending on the temperature, the absolute pressure is in the order of approximately 0.5 to 2 bar at temperatures between about 5° C. and 10° C. This means that an overpressure of about 0.5 to 1 bar relative to the ambient pressure should be maintained in the container. However, maintaining the reference pressure inside the third chamber is difficult over a longer period. Especially when manufacturing tolerances are taken into consideration, a certain loss of pressure from the reference chamber can be expected for storage periods lasting several months, which naturally leads to a corresponding drop in the pressure over the liquid as adjusted by the pressure regulator. Even when using high-quality precision-made parts with small tolerances, losses due to diffusion and migration can be expected in the course of time because it is difficult to achieve a perfect seal of a gas volume over a longer period of time. There is therefore a risk, especially after a long period in storage, that the reference pressure will drop over time, with the result that the pressure regulator is no longer able to set the desired pressure over the liquid.

SUMMARY OF THE INVENTION

It is a first object of the invention to disclose a pressure regulating device for dispensing a fluid under pressure from a container wherein a pressure can be maintained as precisely as possible inside the storage chamber of the container.

It is a second object of the invention to disclose a pressure regulating device for a container from which the fluid may be dispensed to the outside wherein the pressure regulating device may be activated by a user who wishes to dispense fluid, such as beer, from the container.

It is a third object of the invention to disclose a pressure regulating device for a container from which the fluid may be dispensed to the outside wherein a non authorized fluid dispensing is indicated to a potential user.

It is a forth object of the invention to disclose a pressure regulating device for a container from which the fluid may be dispensed to the outside wherein a good sealing of the container is ensured.

It is a fifth object of the invention to disclose a pressure regulating device for a container from which the fluid may be dispensed to the outside wherein a particular pressure can be obtained within the container at high precision and for prolonged periods of time.

These and other objects are achieved according to the invention by providing the pressure regulation mechanism with an axially moveable regulating element that is impinged upon by means of a biasing means in the direction of an open position in which propellant is discharged from the pressure reservoir into the storage chamber, by the ambient pressure to which the container is exposed acting upon the regulating element in the direction of the open position, and by the internal pressure inside the storage chamber of the container acting upon the regulating element in the direction of the closed position.

According to the invention, the internal pressure inside the storage chamber is now set on the basis of the pressure differential between the storage chamber and the external pressure on the container, plus a constant force produced by the biasing means. This has the advantage that the desired pressure regulation range can be adapted by selecting the appropriate biasing means. Optimal tapping of the respective filling can thus be achieved, so wheat beer, for example, can be dispensed with a higher pressure than pils beer or any other carbonated beverage such as mineral water. The set pressure inside the storage chamber is no longer dependent on maintaining a closed gas reservoir, in other words a pneumatic spring, and can be produced mechanically, for example, by means such as a mechanical spring. This ensures that a preset pressure can be established in the storage chamber of the container regardless of how long the container is stored, and even after a protracted period of storage.

Another advantage of the invention is that an empty container can be provided with the pressure reservoir and the pressure regulation mechanism at the manufacturer, and that the container can later be filled independently thereof at the filling plant, while the pressure regulation mechanism can be activated at any chosen time. The pressure regulation mechanism can be activated when the container is filled, for example, or not until some time later, for example by the end-user when he or she wishes to start dispensing the contents. Since a enclosed gas reservoir is not required in order to provide a reference pressure, the structure and assembly of the device according to the invention are greatly simplified and less expensive. Regulation is not impaired, even over protracted storage periods, when plastic injection-molded parts are used to manufacture the device at low cost. The pressure regulation mechanism can be mounted together with the pressure reservoir at any position on the container.

Another advantage of the device according to the invention is that ready-made containers can be fitted with the pressure reservoir and the pressure regulation mechanism by the manufacturer, and filled and/or sealed, without adaptation being necessary, via the center opening in the container lid that is standard in such containers. Conventional filling and sealing plant can therefore be used, such as that commonly used in the beverage industry for party cans, for example, without modifications having to be made to such plant.

In one advantageous development of the invention, the pressure reservoir is configured as a pressure cartridge with an integrated discharge valve.

This enables conventional pressure cartridge to be used, thus achieving simple construction and cost-efficient production.

It is appropriate here to use the kind of pressure cartridges in which the gaseous propellant is combined with a filler additive, such as activated carbon. In this way, a much lower filling pressure can be used in the pressure cartridge that would be possible in the absence of such an absorbent.

In another advantageous embodiment of the invention, the pressure reservoir includes a discharge valve that is biased in the direction of the closed position with a force less than the force exerted by the biasing means.

It is possible in this way to use a pressurized container with a conventional discharge valve, e.g. of the kind generally used for spray cans, without having to make any special modifications. Since the force exerted by the biasing means is greater than the force exerted by the discharge valve, the result is a force difference, acting in the direction of the open position, that balances the force exerted on the regulating element by the pressure differential between the internal pressure of the storage chamber and the external pressure of the container.

Preferably, the discharge valve can be actuated by a valve plunger upon which the regulating element acts.

This results in a pressure regulation mechanism of simple construction, combined with the use of commonly available pressure cartridges provided with such a discharge valve with valve plunger.

In an advantageous development of the invention, the biasing means is configured as a spring.

It is possible here to use any kind of spring. Although a pneumatic spring can essentially be used, a mechanical spring is preferably used in order to avoid the aforementioned disadvantages associated with pneumatic springs. Any kind of mechanical spring, including helical springs, disc springs, wave springs and other types are acceptable in this regard. Such springs are preferably made of metal, but the use of plastics and other materials is also conceivable.

The pressure regulation range can be influenced by the spring characteristic curve selected.

The biasing means preferably has an approximately S-shaped characteristic curve.

Biasing means in which the tensioning force (spring force) is almost independent of the deflection over a selected range are particularly preferred. By such means, the influence of manufacturing tolerances can be compensated and the desired internal pressure inside the container can largely be maintained with precision, irrespective of the extent to which the biasing means is deflected.

In another preferred embodiment of the invention, the regulating element is embodied as a membrane.

This results in highly sensitive control that is not adversely affected by frictional effects such as those which occur in pistons, and which is not sensitive either to manufacturing tolerances. The construction can be designed such that the internal pressure of the storage chamber acts on the one side of the membrane while the ambient pressure acts on the other side of the membrane.

According to a further embodiment of the invention, an actuator element that can be actuated from outside the container is provided for switching the pressure regulation mechanism from an inactive position in which no pressure regulation occurs to an activated position.

In this way, activation of the pressure regulation mechanism can occur completely independently of the container being filled. The container, including the pressure reservoir and pressure regulation mechanism, can therefore be produced in a fully preassembled form by the manufacturer, with no beverage filling being added until the filling plant. The function performed by the pressure regulation mechanism can be activated at any time during or after filling. This makes it possible for the pressure regulation mechanism to remain deactivated until the end-user activates it directly, for example when he or she would like to begin dispensing the contents.

According to another embodiment of the invention, the pressure regulation mechanism includes a valve housing inside which the externally actuatable actuator element is rotatably accommodated via which the biasing means is axially biased by turning it from the inactive position to the activated position in order to impinge upon the regulating element in the direction of the open position.

This enables simple mounting and activation of the regulating element.

According to another embodiment of the invention, the regulating element is accommodated such that it is received axially moveable on a membrane element that can be sealingly connected to the valve housing.

This enables simplified assembly of the device.

The membrane element is preferably configured in such a way that it can snap onto the valve housing and the pressure reservoir. Alternatively, a join can be obtained by welding, for example by friction welding or ultrasonic welding.

Simplified and quick assembly can be assisted by this means also.

According to another embodiment of the invention, the pressure regulation mechanism can be activated by a rotational movement of the actuator element.

This enables the pressure regulation mechanism to be activated in a simple manner.

According to another embodiment of the invention, the biasing means is held between the membrane element, on the one hand, and an intermediate element, on the other hand, wherein the intermediate element can be axially displaced inside the valve housing by turning the actuator element in order to impinge the biasing means against the regulating element in the direction of the open position.

This results in very simple construction and very simple assembly.

In one advantageous development of this embodiment, the actuator element and the intermediate element include cam surfaces by which a rotational movement of the actuator element can be converted into an axial movement of the intermediate element.

This enables the actuator element to be switched easily and quickly from the inactive position to the activated position.

In one appropriate development of the invention, means are provided for limiting the angle of turn between the actuator element and the intermediate element.

The intermediate element is also axially displaceable, but is accommodated inside the valve housing such that it is secured against turning.

In addition, the actuator element is preferably configured such that it can be inserted and snap-locked into the valve housing.

These measures provide support for simple construction and simple assembly.

According to a further embodiment of the invention, a cavity which is sealed against the storage chamber is formed inside the valve housing on the side facing away from the pressure reservoir, the cavity being ventilated to the outside in the activated position.

In an advantageous development of this embodiment, the cavity is sealed in the inactive position against the ambient pressure by sealing engagement of the actuator element with the valve housing and is ventilated to the outside by turning the actuator element to the activated position.

In this manner, the storage chamber is completely isolated in the non-activated state from ambient factors. The interior of the pressure regulation mechanism is protected during filling against unwanted penetration of liquid such as beer or rinsing water. This ensures at the same time that the pressure regulation mechanism is not started up until the end-user activates it, so no losses through leakage can occur prior to such activation.

In a further embodiment of the invention, means are provided for fixing the intermediate element in the activated position.

This ensures that the activated position is kept once it has been reached.

It is expedient here if the actuator element can only be turned in the direction of the activated position, starting from the non-activated position. Suitable toothing can be provided to this end, for example in the valve housing, with which an associated snap-lock element of the actuator element engages.

According to another embodiment of the invention, the membrane element includes a flange that is kept mobile by the membrane, by means of which flange the discharge valve can be actuated.

By this means, the membrane and the discharge valve of the pressure reservoir are able to interact in a simple manner.

According to another embodiment of the invention, the membrane is kept spaced apart from the pressure reservoir by the membrane element, wherein a cavity is formed between the membrane element and the pressure reservoir, into which cavity the discharge valve opens and which communicates via at least one discharge opening with the storage chamber of the container.

This results in simple coupling of the membrane with the pressure reservoir so that the discharge valve can be actuated in order to discharge propellant via the cavity into the storage chamber can .

According to another embodiment of the invention, the membrane element comprising the membrane and the flange is made of plastic, wherein the membrane consisting of a flexible material is produced together with the two other members using the two-component molding technique.

With the two-component molding technique basically known in the prior art, a plurality of plastic parts comprising at least one harder plastic and one softer plastic are produced. By using a suitable injection molding technique, it is possible during production for the softer plastic component to be joined together with the harder plastic component in a material fit. In this way, it is possible for the membrane element with the integrated membrane to be manufactured inexpensively, with a permanent seal between the membrane element and the membrane being achieved in a cost-efficient and reliable manner.

According to another embodiment of the invention, the pressure reservoir is accommodated with the pressure regulation mechanism inside the container and is sealingly mounted by means of the valve housing in an opening in the housing wall, preferably in a lid surface of the container.

In this way, the container can be combined with the pressure regulation mechanism and the pressure reservoir without this being externally noticeable to a user. Fixing the pressure regulation mechanism with the pressure reservoir to a lid surface of the container makes it possible for the propellant to exit directly from the pressure reservoir into the head space of the container during the discharge of fluid from the storage chamber, i.e. when dispensing the fluid, without the propellant having to pass through a liquid accommodated in the storage chamber. The respective disadvantages are thus avoided.

According to another embodiment of the invention, the actuator element includes a handle that is secured in the inactive position by an originality indicator and which permits the actuator element to be gripped and turned to the activated position.

According to another embodiment of the invention, a lock is provided to prevent the pressure regulation mechanism from returning to a deactivated position once it is in an activated position.

This ensures simple manual actuation of the mechanism and provides an indication showing that the device is still in its original state.

The pressure regulation mechanism is also prevented from returning to a non-activated position once it is in an activated position.

It is self-evident that the features of the invention as mentioned above and to be explained below can be applied not only in the specified combination, but also in other combinations or in isolation, without departing from the scope of the invention.

BRIEF DESCRIPTION OF THE DRAWINGS

Additional features and advantages of the invention derive from the following description of preferred embodiments with reference is made to the drawings, in which.

DESCRIPTION OF PREFERRED EMBODIMENTS

Figure 1:
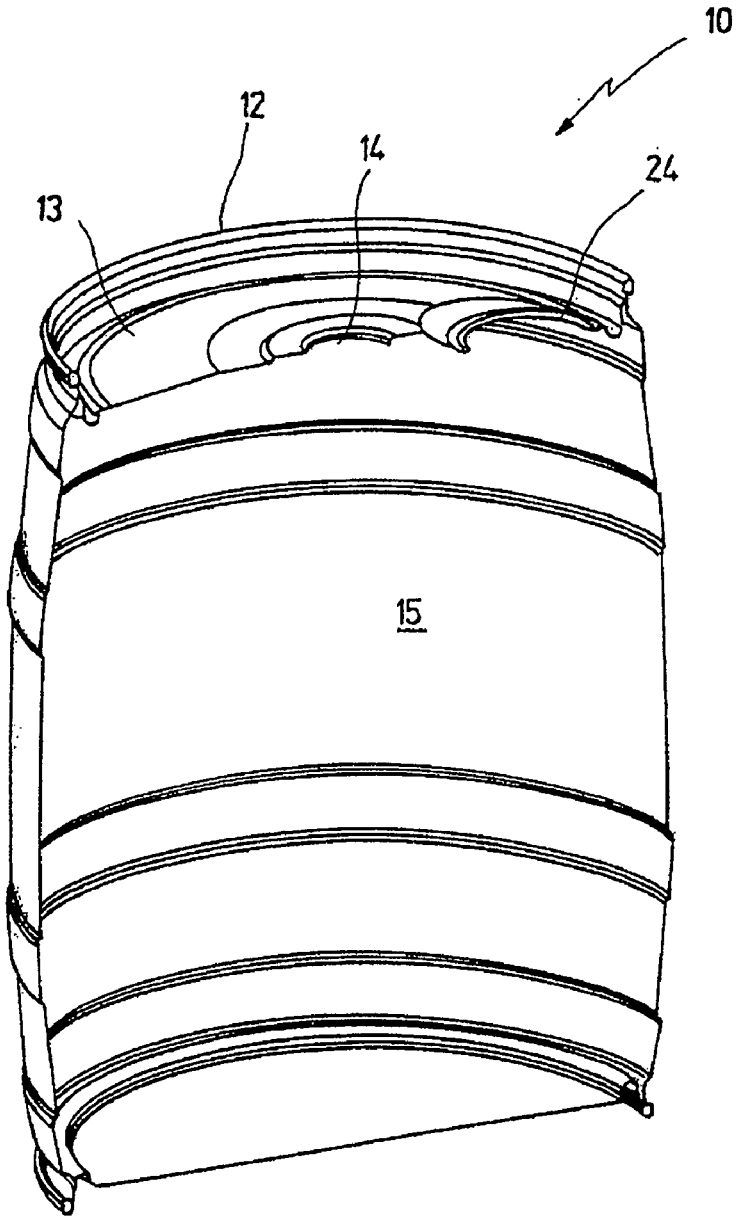
FIG. 1 shows a perspective, partially cutaway view of a container according to the invention, in the form of a party keg, but without the pressure regulation mechanism.

A device according to the invention is shown in FIG. 1, where it is labeled in its entirety with reference numeral 10. Device 10 is a beverage container for receiving a beverage under gas pressure, such as beer. Such containers are available as party kegs with volumes of three, five or ten liters and are provided on their lid surface 13 with a central opening 14 in which a plug is received and which is configured for filling the container and emptying it with a suitable dispensing device, such as the one known from DE 298 22 430 U1.

Although it is not shown in FIG. 1, such a container 10 can also be provided with a dispensing valve integrated in the side wall of the container that can be pulled out when required in order to withdraw fluid from the container, as known, for example, from U.S. Pat. No. 6 053 475, the entire disclosure of which is incorporated by reference in the present disclosure.

Such containers are used, in particular, to keep and tap beer. Although the provision of an additional internal pressure for tapping the fluid is dispensed with in most cases, it is desirable in some applications to provide a specific internal pressure inside the container volume.

Figure 2:
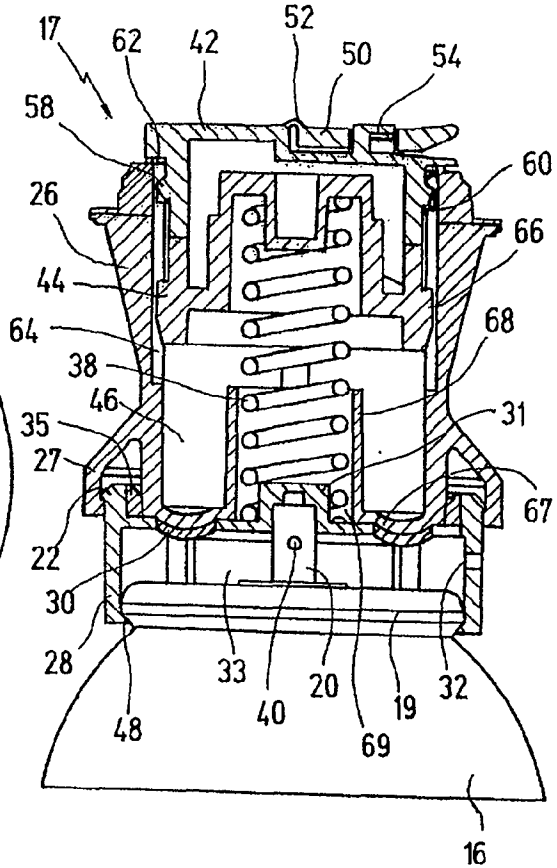
FIG. 2 shows a cross-section through a pressure regulation mechanism onto which a pressure reservoir is flanged, the pressure regulation mechanism being used in the container of FIG. 1, shown in an inactive position.
Figure 3:
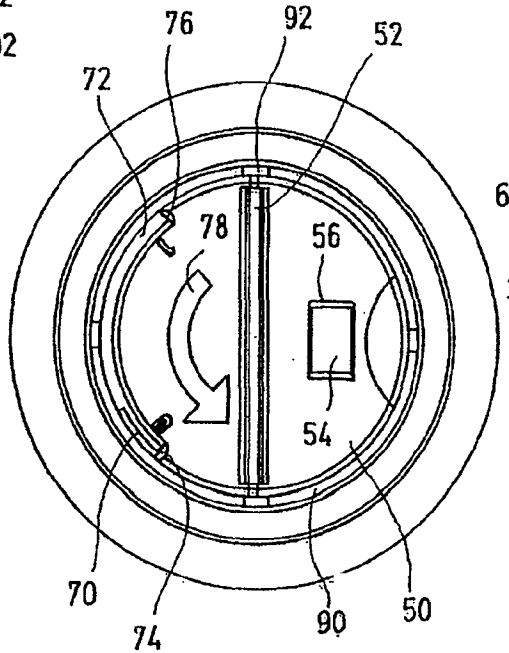
FIG. 3 shows a plan view from above of the pressure regulation mechanism of FIG. 2, which is in the inactive position (in the original state)
Figure 4:
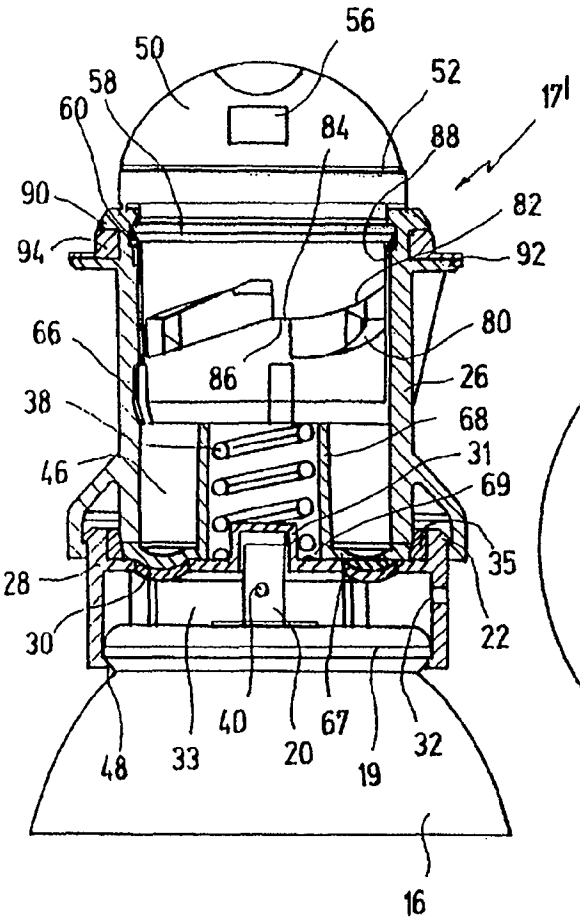
FIG. 4 shows a partially cutaway view of the pressure regulation mechanism of FIG. 2 in the activated position.

According to the invention, a pressure reservoir 16 together with a pressure regulation mechanism 17 pursuant to FIGS. 2-4 is fully integrated for this purpose inside the container. Pressure reservoir 16 is configured as a pressure cartridge of a commonly available type, which is provided with a discharge valve 20 of known design. Discharge valve 20 can be designed like those commonly found in spray cans, for example. It can have a spring-loaded valve element (not shown), by means of which propellant in the pressure cartridge is able to escape via a radial discharge opening 40 (FIGS. 2 and 4) when a valve plunger projecting upwards out of the pressure reservoir is pressed down. Such a pressure reservoir is preferably provided in addition with a sorbent for the pressurized propellant gas accommodated therein, for example $CO_2$. Potential sorbents include activated carbon, for example. This makes it possible to provide sufficient pressure in the pressure cartridge even after protracted withdrawal of propellant from the pressure cartridge, without a very high initial pressure being necessary. Propellant gas can be discharged from the pressure cartridge via pressure regulation mechanism 17 into a storage chamber 15 of container 12 to which a predetermined internal pressure is applied in this manner. For the conditions normally present when tapping beer, it is desirable to maintain an overpressure of approximately 0.2 to 1 bar inside storage chamber 15 relative to the ambient pressure, which corresponds to an absolute pressure of approximately 1.2 to 2 bar inside storage chamber 15. The overpressure inside storage chamber 15 of container 12 is preferably approximately equal to the equilibrium pressure of $CO_2$ and beer in the standard temperature range in which cooled beer is normally tapped. In a temperature range between 5 and 10° C., this results in a preferred overpressure inside storage chamber 15 in the order of 0.7 bar, for example.

The regulation mechanism 17 according to the invention pressure is now configured to maintain a specifically desired overpressure inside storage chamber 15 by discharging propellant from the pressure cartridge into storage chamber 15. Fluid dispensing can be kept up for as long as desired, or interrupted. The particular advantage of a device of this kind is also that further tapping is made possible even days after beer has first been dispensed from the container, without the taste of the beer being adversely affected to any significant extent, as is the case with containers that operate without additional pressure.

The pressure regulation mechanism 17 according to the invention includes a membrane 30 that acts upon the valve plunger of discharge valve 20 in the direction of an open position, and which is additionally impinged upon by a spring 38 in the direction of the open position. The ambient pressure of container 10 acts on the side of membrane 30 facing away from the valve plunger, while the internal pressure in storage chamber 15 of container 12 acts upon the other side of membrane 30. Spring 38 is retained in a valve housing 26 that is mounted in an appropriate manner via a membrane element 28 on the upper edge 19 of the pressure cartridge. Membrane 30 is impinged by spring 38 against the valve plunger in the direction of the open position.

As a result, membrane 30 is acted upon, firstly, by the pressure differential between storage chamber 15 and the ambient pressure of container 12, whereupon membrane 30 is impinged in the direction of the closed position, i.e. away from the pressure cartridge. Secondly, the valve plunger is acted upon by the biasing force of its spring element (not shown), by means of which the valve plunger is biased in the direction of the closed position. In addition, the tension in spring 38 acts on the valve plunger in the opposite direction, that is to say in the direction of the open position.

This leads to as much propellant always being discharged from pressure cartridge 18 via the discharge opening 40 of the valve plunger and from there via a discharge opening 32 of membrane element 28 into storage chamber 15 as is required for a defined internal pressure to be established inside storage chamber 15. The internal pressure is predetermined by the tensioning force of spring 38, minus the force that any spring integrated in discharge valve 20 exerts in the opposite direction. By adjusting the spring curve accordingly, it is therefore possible to adjust the overpressure established in the storage chamber 15 relative to the ambient pressure.

The structure of device 10 shall now be described in greater detail with reference to FIGS. 2 and 4.

Valve housing 26 has an approximately cylindrical shape and is sealingly inserted at its top end into an opening 24 in the lid surface 13 of container 12 of FIG. 1 with the aid of an injected outer seal. Valve housing 26 is open at its top end, but at its bottom end has a base 67 through the middle of which there is a central recess 69 that is enclosed by an upwardly projecting sleeve-shaped extension 68. At the bottom end of valve housing 26 there is a skirting 27 sticking out which defines a free space towards the inside wall of valve housing 26, within which space membrane element 28, in which membrane 30 is held, can be sealingly fixed by means of a snap connection 22. Membrane element 28 is basically bowl-shaped and includes at its center a flange 31 with a central upwardly projecting protrusion which is used for receiving the bottom end of spring 38 and the underside of which also serves to actuate discharge valve 20. Flange 31 is connected via flexible membrane 30 to the outer wall of membrane element 28. On the top side of the membrane element, an annular protrusion is formed whose inside edge is configured as an annular sealing face for sealingly connecting to the bottom end of valve housing 26. Membrane element 28, comprising its flexible membrane 30, its sealing face 35 made of the same material, its central flange 31 and its remaining part, is made using the two-component injection molding technique. The hard parts of membrane element 28 are produced together with the soft membrane 30 and seal 35 in a combined injection molding process resulting in an internal, material fit connection between the soft and hard parts.

As can be seen from FIG. 2, membrane element 28 snaps via snap connection 22 onto the skirting 27 of valve housing 26, seal 35 ensuring thereby that the top side of membrane 30 facing towards the outside of the container can communicate with the cavity 46 formed inside valve housing 26 only through sleeve-shaped extension 68 via recess 69 on the bottom side of valve housing 26.

Membrane element 28 is preferably snap-locked to edge 19 of the pressure cartridge with the aid of a snap connection 48.

Between the upper edge 19 of the pressure cartridge, membrane element 28 and membrane 30, a cavity 33 is enclosed that communicates via the discharge opening 32 of membrane element 28 with storage chamber 15 of container 12. The cavity 33, in which propellant can be discharged from the pressure cartridge via the opening 40 of valve plunger 22, therefore communicates via discharge opening 32 with storage chamber 15.

As already described in the foregoing, this results in propellant being discharged from pressure cartridge 18 via cavity 33 into storage chamber 15 until such time as a predefined pressure differential is established between storage chamber 15 and the ambient pressure that is dependent on the force that spring 38 exerts in the direction of the open position of valve 22, minus any force that a spring element integrated in discharge valve 20 exerts in the opposite direction. By selecting the spring characteristic, the desired pressure inside storage chamber 15 can therefore be influenced in the appropriate manner.

In order to remove fluid from storage chamber 15, a riser tube (not shown) can be introduced into sealing stopper 44, which is inserted into the central opening of lid surface 13 of container 12. It is obvious that the riser tube can be provided with a suitable dispensing valve and a discharge pipe in order to enable the dispensing of fluid from storage chamber 15 to the outside under the effect of the overpressure acting in storage chamber 15. Alternatively, fluid can be dispensed via a dispensing valve integrated in the side wall of container 12, as known from U.S. Pat. No. 6,053,475, for example.

The device 10 according to the invention enables activation of pressure regulation mechanism 17 to be delayed until a predetermined moment.

As already mentioned, spring 38 is supported at its end facing membrane 30 by flange 31, which is connected to membrane 30. At its other end, spring 38 is retained by an intermediate element 44 that is supported by an actuator element 42 that can be actuated from outside container 12. The spring is guided at its bottom end inside the sleeve-shaped extension 68 of valve housing 26 and through a central projection from flange 31. Similarly, spring 38 is retained at its top end in a cylindrical recess in intermediate element 44 and is centered on a protrusion that projects in the direction of membrane element 28.

Pressure regulation mechanism 17 can be switched from a non-activated position, as shown in FIG. 2, to an activated position, shown in FIG. 4, by turning actuator element 42 by an angle of approximately 90°. In the non-activated position, intermediate element 44 is supported in its starting position axially furthest away from membrane element 28 and abutting actuator element 42. In this position, spring 38 does not exert sufficient pressure on flange 31 and hence on discharge valve 20 to enable actuation of the latter. Actuation of discharge valve 20 is therefore not possible in the non-activated position. Axially displacing intermediate element 44 in the direction of membrane element 28 causes spring 38 to be tensioned, with the result that a regulating function is performed to actuate discharge valve 20, depending on the pressure differential between the pressure in storage chamber 15, which is equal to the pressure in cavity 33, the pressure inside cavity 46 inside valve housing 26, and the biasing force of spring 38. To enable axial displacement of intermediate element 44 from the inactive position shown in FIG. 2 to the activated position according to FIG. 4, intermediate element 44 and actuator element 42 each have four cam surfaces 80 and 82 on their outer cylindrical surfaces. The contours of the cam surfaces match each other, as can be seen in FIG. 4. By means of the cam surfaces 80 and 82 running in the axial direction at a slant relative to a radial plane, any turning of actuator element 42 out of the inactive position shown in FIG. 2 leads to intermediate element 44 gliding with its cam surfaces 80 along cam surfaces 82 of actuator element 42 and hence being axially displaced in the direction of membrane element 28 due to the intermediate element being axial displaceable, but guided inside valve housing 26 such that it is secured against turning. For this purpose, intermediate element 44 has a total of four guide ridges 66 on its outer periphery that are guided in axial grooves 64 of valve housing 26. Actuator element 42 can only be turned from its inactive starting position according to FIG. 2 in one direction of rotation, namely the anti-clockwise direction shown by arrow 78 in FIG. 3, and by an angle somewhat less than 90°, until the activated position shown in FIG. 4 is reached.

A stop element 70 projecting upwards from valve housing 26, and which interacts with an associated peripheral recess 72 on the outer periphery of actuator element 42, ensures that the actuator element can only be moved a predefined angle between its two extreme positions. As can be seen from FIG. 3, stop element 70 engages a first end 74 of the peripheral recess 72 in the non-activated starting position shown in FIGS. 2 and 3. This position is made visually distinguishable for the user by means of a "0" marking, as can be seen in FIG. 3. When actuator element 42 is turned in the direction shown by arrow 78 in FIG. 3, it ultimately arrives with the second end 76 of peripheral recess 72 at stop element 70. This position can be visually distinguished by the user from the "1" marking. In the activated position, shown in FIG. 4 and characterized by end 76 abutting stop element 70, cam surfaces 80 and 82 of intermediate element 44 and actuator element 42, respectively, lie one upon the other with portions 86 and 84 extending in radial planes. Thus, when the end position shown in FIG. 4 is reached, a defined end position of intermediate element 44 is likewise reached, in which the intermediate element is retained in a position that is displaced by a defined amount in the direction of membrane element 28.

Snap-locking elements between actuator element 42 and valve housing 26 also ensure that actuator element 42 can only be turned in the one direction as shown by arrow 78, but not in the opposite direction. Suitable toothing can be provided for this purpose on the inner surface of valve housing 26 along its inner periphery, for example, into which a snap-locking element, in the form of a barb, for example, engages (in FIG. 4, a barb projecting outwards from the outer surface of actuator element 42 is only suggested with reference numeral 88).

To make it easier to turn actuator element 42 from the inactive position according to FIG. 2 to the activated position in FIG. 4, a handle 50 is provided on the top of actuator element 42. One half of the upper side of actuator element 42 is pivotably fixed for this purpose via a film hinge 52. In the inactive position according to FIGS. 2 and 3, handle 50 is fixed flush with the outer surface of actuator element 42 and locked in this position by a tear-off element 54 that projects into a viewing window 56. By gripping its outer periphery, handle 50 can now be pulled up and out of this position, as a result of which tear-off element 54 rips and the handle can now be roundly gripped from both sides in the raised position using two fingers to enable actuator element 42 to be turned anti-clockwise in the direction indicated by arrow 78. The tear-off element thus enables any first-ever use of handle 50 to be visually distinguishable and therefore serves as a quality seal verifying the original state. Manually turning the actuator element by gripping its outer periphery is virtually impossible when installed. A tool, such as a pair of pliers or the like, would have to be used.

Actuator element 42 is snap-mounted to valve element 26 by means of a circumferential bulge 58 that engages with a snap ring groove 60 of valve housing 26. However, actuator element 42 is able to rotate inside the valve element 26.

Valve housing 26 ends at its outer end in a circular ridge 90 (cf. FIGS. 3 and 4) that is slotted in an axial direction at four points 92. An additional circular ridge 92 is molded on the outer surface of valve housing 26, offset from circular ridge 90 by some millimeters in the direction of membrane element 28, its outward radial projection being greater than that of the first circular ridge 90. Between these two circular ridges 90, 92, a soft sealing mass is injected using the two-component technique that also covers the outwardly facing surface of circular ridge 92. The two circular ridges 90, 92 are used, in combination with injected seal 94, to sealingly mount pressure regulation mechanism 1.7 and 17' in the opening 24 on the lid surface 13 shown in FIG. 1.

When pressure regulation mechanism 17 is in the inactive position shown in FIG. 2, cavity 26 formed inside valve housing 26 is also completely sealed against the ambient surroundings. This is achieved with a sealing face 62, likewise injected using the two-component technique, between the external face of the external circular ridge 90 of valve housing 26 and the associated contact surface of actuator element 42. In the inactive position according to FIG. 2, cavity 46 is therefore completely sealed inside valve housing 26 against ambient air. This protects cavity 46 of pressure regulation mechanism 17, 17' during filling against any penetration of fluid, such as beer or rinsing water. Ventilation of cavity 46 to the outside, which is necessary for pressure regulation mechanism 17, 17' to function, does not occur until actuator element 42 is turned from the inactive position to the active position 17' shown in FIG. 4. A small raised segment (not shown) is formed on seal 62 on the front face of valve housing 26 and engages form-lockingly and sealingly with a matching indentation (not shown) on the underside of the cover surface of actuator element 42. When actuator element 42 is turned, the raised segment is moved out of the indentation. In the final position of actuator element 42, in the activated position pursuant to FIG. 4, the raised segment has the effect that the sealing faces between valve housing 26 and actuator element 42 no longer lie sealingly one on top of the other, with the result that ventilation to the surroundings is established. An axial slot is also provided at a suitable place in the circumferential bulge 58 on actuator element 42, by means of which slot sufficient ventilation of cavity 46 to the outside is assured when in the activated position.

Although spring 38 is shown in the Figures as a helical spring, it is understood that any other types of spring, such as disc springs, wave springs, spiral springs and other forms of construction can be used. It is preferred that the spring 38 being used will apply the predetermined spring force with as much precision as possible in the activated state, since it is by this means that the adjusted pressure inside storage chamber 15 is predefined. In order to reduce the influence of manufacturing tolerances, it is preferred that spring 38 be configured with an approximately S-shaped spring characteristic curve, as illustrated in FIG. 5.

Figure 5:
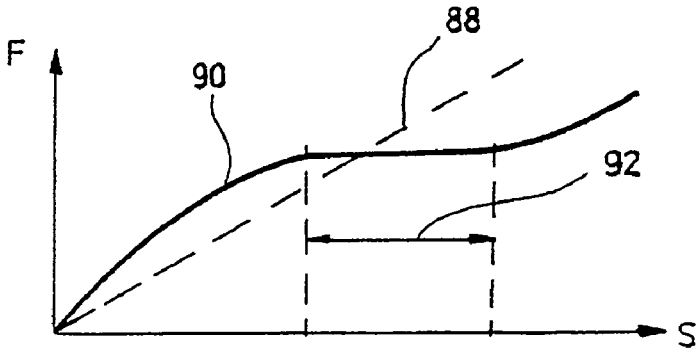
FIG. 5 shows a schematic view of a spring curve of the regulating element, which has an S-shaped curve.

FIG. 5 shows the spring force F exerted by the spring as a function of the spring deflection s. A normal linear spring curve is indicated by broken line 88. This means that as the deflection s increases, the spring force increases linearly. An S-shaped spring curve of the preferred kind, indicated with reference numeral 90, has a working range 92 within which the force F exerted by the spring changes either not at all or only to an insignificant extent even when there is a change in the spring deflection s. Spring 38 is preferably designed and mounted in such a way that it is actuated/operated within operating range 92 when pressure regulation mechanism 17 is in the activated state. The effect of this is that, even when spring 38 is imprecisely positioned in relation to the valve plunger, the tensioning force exerted by spring 38 is approximately constant over a certain range, with the result that the desired target pressure inside storage chamber 15 is adjusted independently of any such mispositioning of spring 38.

Suitable spring designs having an S-shaped characteristic curve are commercially available.

What is claimed is:

1. A device for dispensing a fluid from a storage chamber of a container via at least one closeable discharge port to the outside, the device comprising:

a pressure reservoir being separated from the storage chamber and containing a pressurized propellant;

a discharge valve communicating with said pressure reservoir allowing discharge of propellant from said pressure reservoir upon activation;

a pressure regulation mechanism communicating with said storage chamber and said discharge valve, said pressure regulation mechanism having an open position in which propellant is discharged via said discharge valve into said storage chamber and having a closed position in which there is no discharge of propellant into said storage chamber;

said pressure regulation mechanism comprising a regulating assembly having a regulating element that is axially movable against said discharge valve for discharging propellant from said pressure reservoir;

a biasing element for biasing said regulating element into the direction of said open position;

an actuator member cooperating with said pressure regulation mechanism being accessible from outside the container and allowing transferring the pressure regulation mechanism from an inactive position in which no pressure regulation occurs into an activated position in which pressure regulation is activated; and a lock cooperating with said actuator member so as to allow transferring the pressure regulation mechanism from an inactive position into an activated position but to prevent transferring the pressure regulation mechanism from an activated position into an inactive position;

wherein said pressure regulation mechanism further comprises a valve housing inside which said actuator member is held rotatably;

wherein said valve housing on a side facing away from said pressure reservoir further comprises a cavity which is sealed against said storage chamber in said inactive position, said cavity being ventilated to the outside in said activated position.

2. The device of claim 1, wherein the actuator member is configured for engaging the biasing means upon rotation from the inactive position to the activated position in order for biasing the regulating element into the direction of the open position.

3. The device of claim 2, wherein said regulating element is received axially moveably on a membrane member that can be sealingly connected to the valve housing.

4. The device of claim 1, wherein the pressure regulation mechanism is activated by a rotational movement of the actuator member.

5. The device of claim 2, wherein said biasing means is held between the regulating element, on the one hand, and an intermediate member, on the other hand, wherein said intermediate member can be axially displaced inside the valve housing by turning the actuator member in order to impinge the biasing means against the regulating element in the direction of the open position.

6. The device of claim 5, further comprising means for limiting an angle of turn between the actuator member and the intermediate member.

7. The device of claim 5, wherein said intermediate member is received inside the valve housing axially displaceably, but secured against rotation.

8. The device of claim 5, wherein said actuator member is configured for inserting into and snap-locking with the valve housing from the outside.

9. The device of claim 1, characterized in that the regulating element is configured as a membrane that is held spaced apart from said pressure reservoir by a membrane member, wherein a cavity is formed between the membrane member and the pressure reservoir, into which cavity the outlet valve opens and which communicates via at least one discharge opening with the storage chamber of the container.

10. The device of claim 5, further comprising a means for securing said intermediate member in said activated position.

11. A device for dispensing a fluid from a storage chamber of a container via at least one closeable discharge port to the outside, the device comprising:

a pressure reservoir being separated from the storage chamber and containing a pressurized propellant;

a discharge valve communicating with said pressure reservoir allowing discharge of propellant from said pressure reservoir upon activation;

a pressure regulation mechanism communicating with said storage chamber and said discharge valve, said pressure regulation mechanism having an open position in which propellant is discharged via said discharge valve into said storage chamber and having a closed position in which there is no discharge of propellant into said storage chamber;

said pressure regulation mechanism comprising a regulating assembly having a regulating element that is axially movable against said discharge valve for discharging propellant from said pressure reservoir;

a biasing element for biasing said regulating element into the direction of said open position;

an actuator member cooperating with said pressure regulation mechanism being accessible from outside the container and allowing transferring the pressure regulation mechanism from an inactive position in which no pressure regulation occurs into an activated position in which pressure regulation is activated;

wherein the actuator member includes a handle that is secured in the inactive position by an originality indicator and which permits the actuator member to be gripped and moved to the activated position, the originality indicator indicating a first movement of the actuator member into the activated position;

wherein said originality indicator includes a tear-off element projecting into a viewing window, the tear-off member fixing said handle flush with an outer surface of said actuator element.

12. The device of claim 4 wherein said pressure regulation mechanism comprises a membrane assembly having a flexible membrane and a rigid flange held by said membrane axially movably against said discharge valve for discharging propellant from said pressure reservoir;

wherein said flexible membrane and said rigid flange are formed as an integral plastic part by a two-component molding process.

13. The device of claim 12, wherein said membrane is held spaced apart from said pressure reservoir by said membrane assembly, wherein a cavity is formed between the membrane member and the pressure reservoir, into which cavity thedischarge valve opens and which communicates via at least one discharge opening with the storage chamber of the container.

14. The device of claim 11, wherein said biasing element is configured as a spring having an approximately S-shaped force-deflection characteristic curve.

15. The device of claim 11, characterized in that the pressure reservoir is received together with the pressure regulation mechanism inside said container and is sealingly mounted within an opening in a wall of said container.

16. The device of claim 11, wherein said pressure regulation mechanism further comprises a valve housing inside which said actuator member is held rotatably, the actuator member engaging the biasing means upon rotation from the inactive position to the activated position in order for biasing the regulating element into the direction of an open position in which said regulating element impinges on said discharge valve for opening same.

* * * * *